United States Patent [19]

Selleck

[11] Patent Number: 5,075,998

[45] Date of Patent: Dec. 31, 1991

[54] GUN CLEANING ROD WITH SWIVEL HANDLE

[76] Inventor: Albert B. Selleck, 87 Coney Island Dr., Sparks, Nev. 89431-6317

[21] Appl. No.: 583,031

[22] Filed: Sep. 14, 1990

[51] Int. Cl.[5] ..... F41A 29/02

[52] U.S. Cl. ..... 42/95; 15/104.2

[58] Field of Search ..... 15/104.16, 104.165, 15/104.2; 42/90, 95, 96

[56] References Cited

U.S. PATENT DOCUMENTS

| | | | |
|---|---|---|---|
| 1,237,056 | 8/1917 | Kitchen | 15/104.16 |
| 3,208,302 | 9/1965 | Lewis et al. | 42/95 |
| 4,127,954 | 12/1978 | Hausmann | 42/50 |
| 4,674,218 | 6/1987 | Bottomleg | 42/95 |
| 5,001,973 | 3/1991 | Holcomb | 15/29 |

FOREIGN PATENT DOCUMENTS

| | | | |
|---|---|---|---|
| 34025 | 8/1905 | Switzerland | 15/104.165 |

*Primary Examiner*—Stephen C. Bentley

*Attorney, Agent, or Firm*—John Joseph Hall

[57] ABSTRACT

A gun cleaning rod with a swivel handle having a rod member with an attached brush which has the capability of rotating freely upon being inserted into the bore of a gun barrel along the rifling of the bore without damaging the barrel and capable of withstanding great stress, solvents, and rust.

2 Claims, 1 Drawing Sheet

GUN CLEANING ROD WITH SWIVEL HANDLE

BACKGROUND OF THE INVENTION

1. Field of the Invention

The present invention relates to a gun cleaning rod with a swivel handle which permits the rod member to rotate while cleaning a rifled gun barrel, thereby eliminating any damage to the barrel during the cleaning process. Further, the construction of the invention permits it to function like a ball bearing assembly without a ball bearing, provides complete resistance to solvents, and is rust free, and can withstand extreme pressure and usage.

2. Description of the Prior Art

Applicant is unaware of prior art devices having the construction or capability of use of applicant's invention.

SUMMARY OF THE INVENTION

The present invention provides a gun cleaning rod with swivel handle having a novel construction. A rod member with a stainless steel washer welded in place is inserted into a bearing member forming a bearing assembly which then inserted into the swivel handle. A handle cap is then sonic welded into the outer end of the swivel handle in such a manner as to permit rotation of the bearing assembly as the rod member equipped with a brush at its outer end is inserted into the bore of a gun barrel. The swivel handle and bearing assembly permits rotation of the brush and rod member in conformity with the rifling of the bore of the gun barrel as the rod member is pushed into the bore for cleaning purposes, thereby preventing any damage to the rifling or the bore of the gun barrel.

The rod member and welded washer are preferably made of stainless steel and the other parts are preferably made of a suitable thermoplastic resin such as DELRIN acetal resin or CELCON acetal copolymer based on trioxane.

It is therefore, an object of this invention to provide a gun cleaning rod with swivel handle which works like a ball bearing assembly without a ball bearing in cleaning the rifled bore of a gun barrel.

Another object of this invention is to provide a gun cleaning rod with swivel handle which will withstand more pressure than a ball bearing.

A further object of this invention is to provide a gun cleaning rod with swivel handle which needs no lubrication when in use.

A yet further object of this invention is to provide a gun cleaning rod with swivel handle which is rust free in use and solvent resistant in use.

These and other objects will be more readily understood by reference to the following description and claims, taken in conjunction with the accompanying drawings, in which FIG. 1 is a perspective of the invention illustrating a preferred embodiment of the invention.

DESCRIPTION OF A PREFERRED EMBODIMENT

Figures 1, 2, 3, 4, 5, 6:
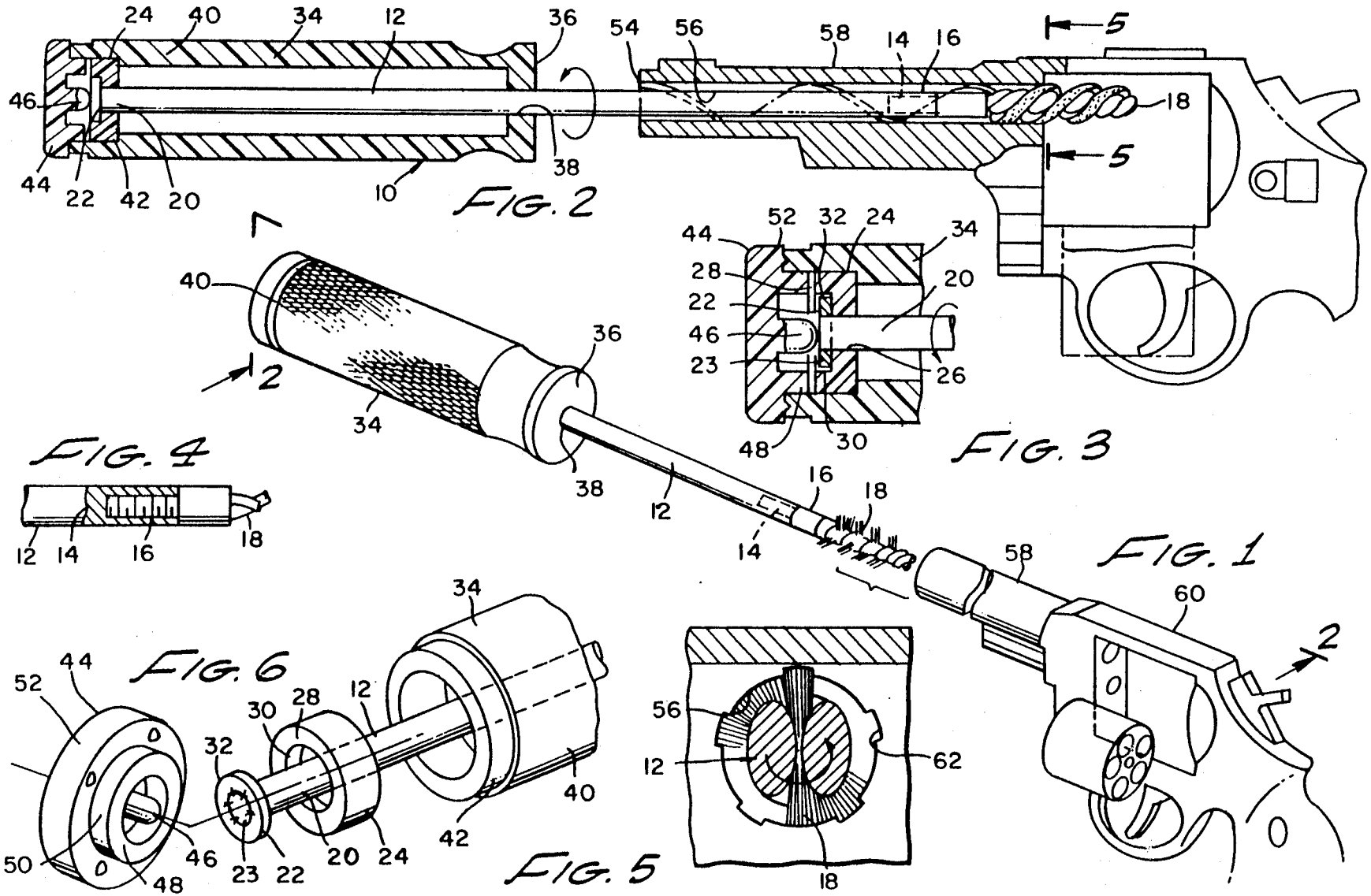
FIG. 2 is a side elevational cross section taken on lines 2—2 of FIG. 1.
FIG. 3 is an enlarged fragmentary side elevational cross section of the bearing assembly of the swivel handle.
FIG. 4 is a fragmentary side elevational view illustrating the threaded connection between the cleaning rod member and a cleaning brush.
FIG. 5 is a cross sectional view taken on line 5—5 of FIG. 2 of the cleaning brush engaging the rifling of the bore or a gun barrel.
FIG. 6 is an exploded perspective view of the cleaning rod bearing assembly.

A preferred embodiment of the invention 10 is provided with a straight thin rod member 12 preferably solid throughout with a threaded recess 14 in its outer end 16 adapted to receive a cleaning brush member 18. Rod member is preferably made of stainless steel or other suitable material and may vary in length from 4 to 42 inches and its diameter may vary from 0.160 to 0.25 inches.

The inner end 20 of rod member 12 may be formed into a washer member 22 or provided with a washer 22 welded to the inner end 20. The washer member is preferably made of stainless steel or other suitable material.

The outer surface of washer 22 has preferably a slight central indentation 23.

The preferred embodiment 10 is provided with a circular bearing member 24 having a central opening 26 through which rod member 12 passes. The inner end 28 of bearing member 24 has a circular recess 30 centrally located around the opening 26.

The diameter of recess 30 is adapted to the diameter of washer 22. Recess 30 receives washer 22 so that the outer surface 32 of washer 22 is flush with the outer surface of bearing member 24 when the preferred embodiment 10 is assembled for use, thereby providing a bearing assembly with the function of a ball bearing.

Bearing member 24 is preferably made of a thermoplastic resin plastic such as DELRIN acetal resin, but may be made of any suitable material with the requisite strength. Preferred dimensions for bearing member 24 are an outside diameter of about 0.695 inches, a thickness of about 0.28 inches, and an inside diameter of about 0.40 inches for circular recess 30 with a depth of about 0.06 inches of circular recess 30.

These dimensions may be varied plus or minus 10% as desired without adversely affecting the operation of the invention, or even more provided that the ratios to each member are preserved as to size.

Preferred embodiment 10 is provided with a hollow swivel handle 34 which is closed at its inner end 36 except for an opening 38 to permit insertion of rod member 12.

Swivel handle 34 has an interior diameter of about 0.59 inches throughout most of its length except toward its open outer end 40 where the interior diameter is increased to about 0.705 inches along the last ½ inch of swivel handle 34, thereby forming a circular ledge 42 which acts as a seat for bearing member 24.

The open outer end 40 of swivel handle 34 is closed by circular handle cap 44, which has a centrally located protuberance or knob 46 on its inner surface projecting inwardly and touching the central indentation on the outer surface of washer 22.

The inner surface of handle cap 44 is formed into a ring member 48 having a flat upper surface 50 and surrounding the knob 46. Ring member 48 has an outside diameter equal to the inside diameter of the outer end of swivel handle 34. The height of ring member 48 is slightly less than the height of knob 46.

The outer rim 52 of handle cap 44 has the same diameter as the outside diameter of swivel handle 34.

The various dimensions referred to above may be varied plus or minus 10% without adversely affecting the operation of the invention, so long as the ratios of dimensions of the various elements are maintained. The above elements may be made from a suitable resin such as a thermoplastic resin known as DELRIN acetal resin or CELCON acetal copolymer based on trioxane having the requisite strength and capability of being subject to sonic welding to fuse or weld the parts together when assembled as follows.

The preferred embodiment 10 is assembled by passing the inner end 20 of rod member 12 into the open outer end 40 of swivel handle 34 and then pushing rod member 12 through the opening 38 at the inner end 36 of swivel handle 34 until the inner surface of bearing member 24 is seated on the circular ledge 42 inside the outer end 40 of handle cap 44 and the outer surface 32 of washer 22 is flush with the inner surface of bearing member 24, to form a bearing assembly.

Handle cap 40 is then inserted into the outer end 40 of swivel handle 34 and firmly attached thereto by sonic welding, preferably, or by other suitable means.

The preferred embodiment 10 described above requires no lubrication in use, is rust free, and will remain rust free after use, and is completely resistant to solvents used in cleaning guns. The preferred embodiment 10 has a construction which will withstand extreme pressures, as high as 10,000 psi, more than conventional ball bearings.

In operation of the preferred embodiment 10, a cleaning brush 18 is inserted into the outer end of rod member 12 by threading. The brush 18 is then inserted by passing the rod member 12 into the outer end 54 of the bore 56 of a barrel 58 of a gun 60. Due to the operation of the swivel handle and its capability of ball bearing action, the brush 18 and rod member 12 rotate freely along the rifling 62 of bore 56 upon insertion therein, whereby easy, safe, and efficient cleaning of barrel 58 is achieved, without any damage to the barrel 58.

Although I have described my invention in detail with reference to a preferred embodiment, it is understood that various modifications may be made in the construction and arrangement of parts of the invention without departing from the spirit and scope of the invention as hereinafter claimed.

I claim:

1. A gun cleaning rod with swivel handle comprising:

an elongated rod member having a washer mounted at its inner end and having its outer end formed with a threaded recess therein for receiving a cleaning brush;

a bearing member having a central opening through which said rod member passes and having a circular recess at its inner end, said recess receiving said washer of said rod member;

a hollow swivel handle closed at its inner end and having an opening in said inner end through which said rod member passes; and a handle cap closing the outer end of said swivel handle by sonic welding, said handle cap having a centrally located knob member on its inner surface, said knob member projecting inwardly and touching the outer surface of said washer, and having its inner surface formed into a ring member having a flat upper surface and surrounding said knob member.

2. A gun cleaning rod with swivel handle comprising:

an elongated rod member having a washer mounted at its inner end and having its outer end formed with a threaded recess therein for receiving a cleaning brush;

a bearing member having a central opening through which said rod member passes and having a circular recess at its inner end, said recess receiving said washer of said rod member;

a hollow swivel handle closed at its inner end and having an opening in said inner end through which said rod member passes;

a handle cap closing the outer end of said swivel handle by sonic welding, said handle cap having a centrally located knob member on its inner surface, said knob member projecting inwardly and touching the outer surface of said washer, and having its inner surface formed into a ring member having a flat upper surface and surrounding said knob member, said ring member having an outside diameter equal to the inside diameter of the outer end of said swivel handle and having a height below the height of said knob member.

* * * * *